US005079540A

United States Patent [19]

Narlow et al.

[11] Patent Number: 5,079,540

[45] Date of Patent: Jan. 7, 1992

[54] THEFT DETECTION TAG WITH ADJUSTABLE LOOP

[75] Inventors: Doug Narlow, Coral Springs; Arjen Koch, Fort Lauderdale, both of Fla.

[73] Assignee: Sensormatic Electronics Corporation, Deerfield Beach, Fla.

[21] Appl. No.: 578,630

[22] Filed: Sep. 6, 1990

[51] Int. Cl.[5] ..... G08B 13/22

[52] U.S. Cl. ..... 340/572; 70/57.1; 340/693; 340/551

[58] Field of Search ..... 340/572, 551, 693; 70/57.1

[56] References Cited

U.S. PATENT DOCUMENTS 4,196,424 4/1980 Williamson ..... 340/572

4,962,369 10/1990 Close ..... 340/572

*Primary Examiner*—Glen R. Swann, III

*Attorney, Agent, or Firm*—Robin, Blecker, Daley & Driscoll

[57] ABSTRACT

A theft detection tag is formed from first and second sections which define a loop for receipt of an article part and which are connected by a coupling adapted to be quickly activated so as to change the loop and thereby permit quick attachment and release of the tag and article. In a first form of the tag, the first tag section includes a body having an upper end and the second tag section includes wedge means movable within the body to form the loop with the upper body end. In a second form of the tag, the first section includes a flexible member having at one end teeth and the second member includes a body with a channel for receiving the one end of the flexible member.

25 Claims, 4 Drawing Sheets

THEFT DETECTION TAG WITH ADJUSTABLE LOOP

BACKGROUND OF THE INVENTION

This invention relates to theft protection devices and, in particular, to a theft detection tag adapted to be attached to, and to be subsequently quickly released from, an article to be protected.

Preventing the theft of small articles (for example eye glasses or jewelry) in a retail environment is particularly difficult. A thief can simply wear, on his or her body, the small article thereby eluding all but the most astute security personnel. Furthermore, a thief can quickly and easily hide a small article in a pocket, a bag, or under clothing.

Detection tags have thus been developed to prevent this type of theft. Such theft detection tags are attached to the articles being protected in a manner which prevents easy removal by a thief. Usually, a special tool is required for removal and is provided only to authorized personnel. Alternatively, in some types of the theft detection, the tags can be hidden in or on the article so that the thief is not aware of its presence.

When using theft detection tags, a sensing device is located near the exits of the premises where the articles are being sold. If an article, having an attached tag, is brought near or past the sensing device, an alarm is initiated. The interaction between the tag and the sensing device can be accomplished using a variety of technologies. For example, the tag may be of the magnetic, microwave or radio frequency type. The sensing device will then be of a type responsive to the particular type of energy (i.e., magnetic, microwave or radio frequency) supported by the tag.

The detection tags generally in use today are not easily used with small articles. Thus, small articles, such as eye glasses, jewelry and tools, have unique form factors that prevent traditional tags from being easily attached. Furthermore, while tags having specifically configured attachment features have been designed for small articles, these specifically designed tags have attachment and removal means that are too cumbersome and slow.

One particular tag which has been developed for eyeglasses comprises a housing having at a first end a first member which defines with the remainder of the housing and an inner mechanism carried within the housing, a loop through which the arm of the eyeglasses can be passed. The inner mechanism is mounted by screw threads to the housing and is driven by key introduced into a second end of the housing. By rotating the inner mechanism with the key, the upper end of the inner mechanism defining the lower end of the loop can be raised or lowered, thereby decreasing the through passage defined by the loop. In this way, the eyeglass arm can be attached and released from the tag.

As can be appreciated, with the aforesaid tag, the need to screw and unscrew the inner mechanism to attach and detach the tag is cumbersome and time consuming. Furthermore, the loop of the tag is not usable for small circular objects because of the fixed nature of the upper loop end.

It is therefore an object of the present invention to provide an improved tag apparatus and method for protecting small articles from theft.

It is a further object of the present invention to provide a tag adapted to be attached to small articles such that the attachment and the release of the tag can be quickly and easily performed.

SUMMARY O THE INVENTION

In accordance with the principles of the present invention, the above and other objectives are realized in a theft detection tag and method in which a tag is provided having a first portion and a cooperating second portion which together form a loop for the tag. The loop defines a through aperture for receiving a part of the article to be protected and the tag is adapted to permit quick attachment and quick release of a means adapted to couple the first and second portions of the tag. This allows the loop and, therefore, the loop aperture to be quickly reduced and increased in size to thereby quickly attach and detach the tag from the article. In the preferred tag configurations, release of the coupling means requires an unlocking mechanism such as a key or magnet.

In a first embodiment of the invention to be described hereinafter, the first portion of the tag is formed by an upper end of the tag housing and the second cooperating portion defining a loop with the first portion includes a pair of opposing wedges translatably mounted in the housing. The coupling means comprises a spring attached to the lower wedge and biased to engage ledges or teeth on the inner surface of the housing. By urging the lower wedge upward, the spring is caused to engage teeth closer to the first tag portion and by releasing the spring the wedge is free to move away from the first tag portion. In this way, the upper wedge, which defines the through area of a loop with the first tag portion, is decreased or increased in size to attach and release the article to be protected.

In a second embodiment of the invention, the first tag portion includes a flexible member which is bent to be received and passed through a chamber or channel at the side of the tag housing. This flexible member also includes channels or teeth which couple with a spring supported in the housing. By urging the flexible member downward through the chamber, the aperture size of a loop defined by the member and the tag housing can be decreased to attach the tag to an article. By releasing the spring, the flexible member becomes released and can be urged upward to increase the loop aperture and detach the tag.

BRIEF DESCRIPTION OF THE DRAWINGS

The above and other features and aspects of the present invention will become more apparent upon reading the following detailed description in conjunction with the accompanying drawings, in which.

DETAILED DESCRIPTION

Figure 1A:
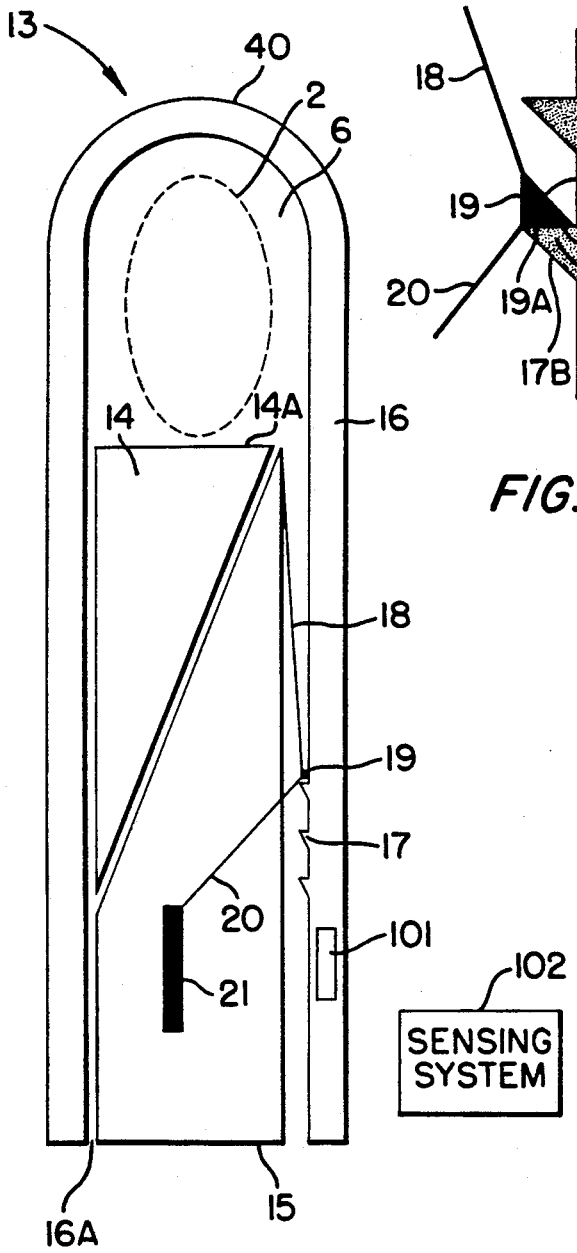
FIG. 1A shows a first embodiment of a theft detection tag in accordance with the principles of the present invention.

FIG. 1A illustrates a first embodiment of a detection tag 13 in accordance with the principles of the present invention. As shown, the tag 13 comprises a first portion or section in the form of a tag body or housing 16 having an upper end 40. The tag 13 also comprises a second portion or section formed by mating upper and lower triangular wedges 14 and 15 disposed within the tag body 16.

As can be appreciated the upper end 40 of the tag body and the top 14A of the upper wedge 14, form a loop. This loop has a through aperture or opening 6 for receiving a part 2 (schematically indicated in dot-dashed line) of an article to be attached to the tag. The article part 2 might be the arm of a pair of eyeglasses or other like article, and by decreasing and increasing the size of the aperture 6, via movement of the wedges 14 and 15, the article part and, hence, the article can be attached and released from the tag.

A spring arm 18 attached to the upper end of wedge 15 and teeth or ledges 17 on the inner surface of body 16 serve to latchingly couple the first and the second sections of the tag formed by body 16 and wedges 14 and 15. This coupling permits various sizes of the aperture 6 to be realized for attachment to various size articles.

Figure 1B:
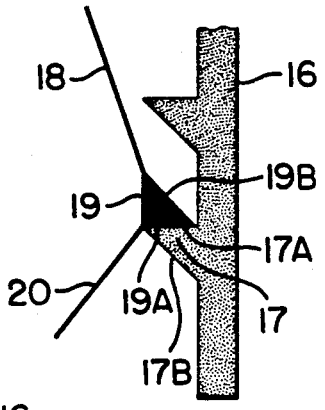
FIG. 1B illustrates the coupling mechanism of the tag of FIG. IA in greater detail.

FIG. 1B is an exploded view of the latching of the teeth 17 on the inner surface of body 16 and spring 18. Each tooth 17 has a flat top 17A and an angled side edge 17B. The latching end 19 of the spring 18 has a flat bottom 19A and an angled side edge 19B. The biasing action of the spring 18 forces the latching end 19 towards the tag body 16.

When a downward force is applied to the bottom wedge 15, the flat bottom 19A of the latching end 19 presses against the flat top 17A of the tooth 17, thereby preventing movement in the downward direction. However, when an upward force is applied to the bottom wedge 15, the angled side edge 17B of the tooth applies a sideways force against the angled side edge 19B of the latch. The latching end 19 is therefore moved inwards, towards the bottom wedge 15, thus allowing the latching end 19 and the bottom wedge 15 to move in an upward direction. By continued upward force on the wedge 15, the desired upward position of the wedge 14 is realized at which time, the latching end 19 is again latched to a tooth 17 to inhibit downward movement of the wedges.

Figure 1C:
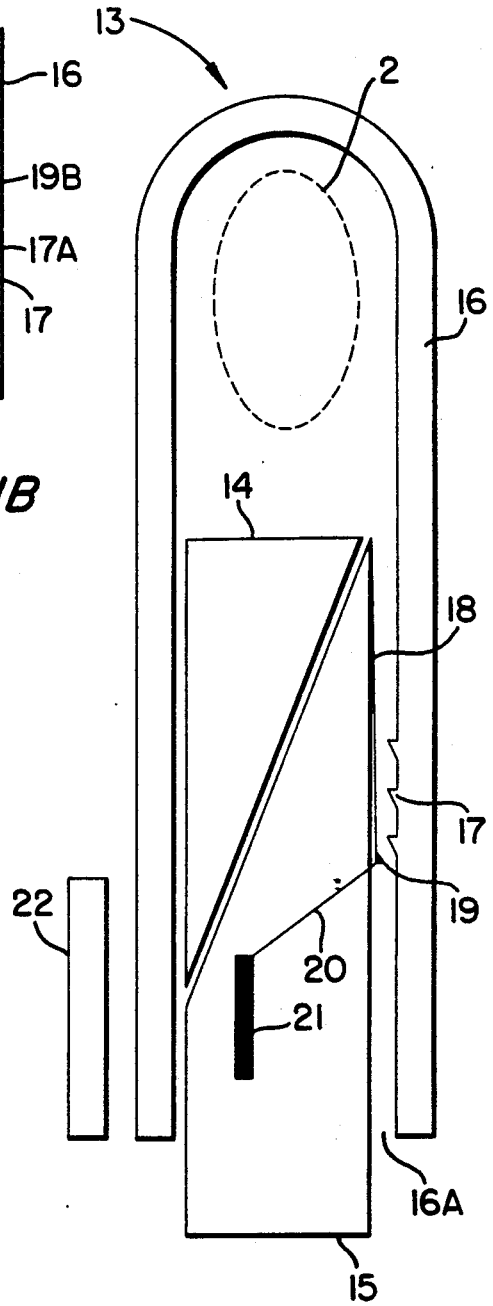
FIG. 1C shows the tag of FIG. 1 in an unattached state.

FIG. 1C illustrates how the tag 13 of FIG. IA can be released from an attached article by permitting downward movement of the wedge 15. More particularly, this is accomplished by overcoming the biasing action on the spring arm 18, thereby moving the latching end 19 sufficiently inwards (towards the bottom wedge 15) so that the end 19 clears the teeth 17.

In the case shown, a translationally mounted metal plate 21 is connected through a connecting link 20 to the latching end 19. When a magnet 22 is placed closely adjacent to the tag body 16, the attractive force between the metal plate 21 and the magnet 22 causes the plate to move in the direction of the magnet. This movement is coupled by link 20 to the spring arm 18, overcoming the biasing action on the spring arm and moving the latching end 19 the desired amount inwards. The bottom wedge 15, and, therefore, the upper wedge 14 can now be moved in a downward direction, enlarging the opening 6 and releasing the article.

As can be appreciated, the coupling mechanism used in the tag 13 permits quick attachment of the tag to an article simply by exerting an upward force on the bottom wedge 15. Similarly, the coupling mechanism permits quick release simply by removing the bias on the spring 18.

The tag 13 may be designed so that pushing of the wedge 15 upward can be accomplished manually or by using a tool. In the former case, as shown in FIG. 1C, the bottom of the tag body 16 is open, allowing the bottom wedge 15 to protrude outside the opening 16A at the bottom of tag body 16. A limiting member (not shown) prevents the bottom wedge 15 from sliding completely out of the tag. To attach the tag, pressure is applied by the finger or hand directly to the bottom wedge 15, thereby moving the wedge up and locking it at the appropriate position for attachment of the tag to the article.

Alternatively, the tag 13 may be designed so that a tool is required to force the bottom wedge 15 upward. In such case, the opening 16A at the bottom of the tag body 16 may be designed to receive a preconfigured tool or key for pushing the bottom wedge 15 upward. The size and the shape of the opening 16A may also be designed to prevent any tools other than a preconfigured tool from entry so as to ensure unauthorized attachment or release of the tag.

Figure 2:
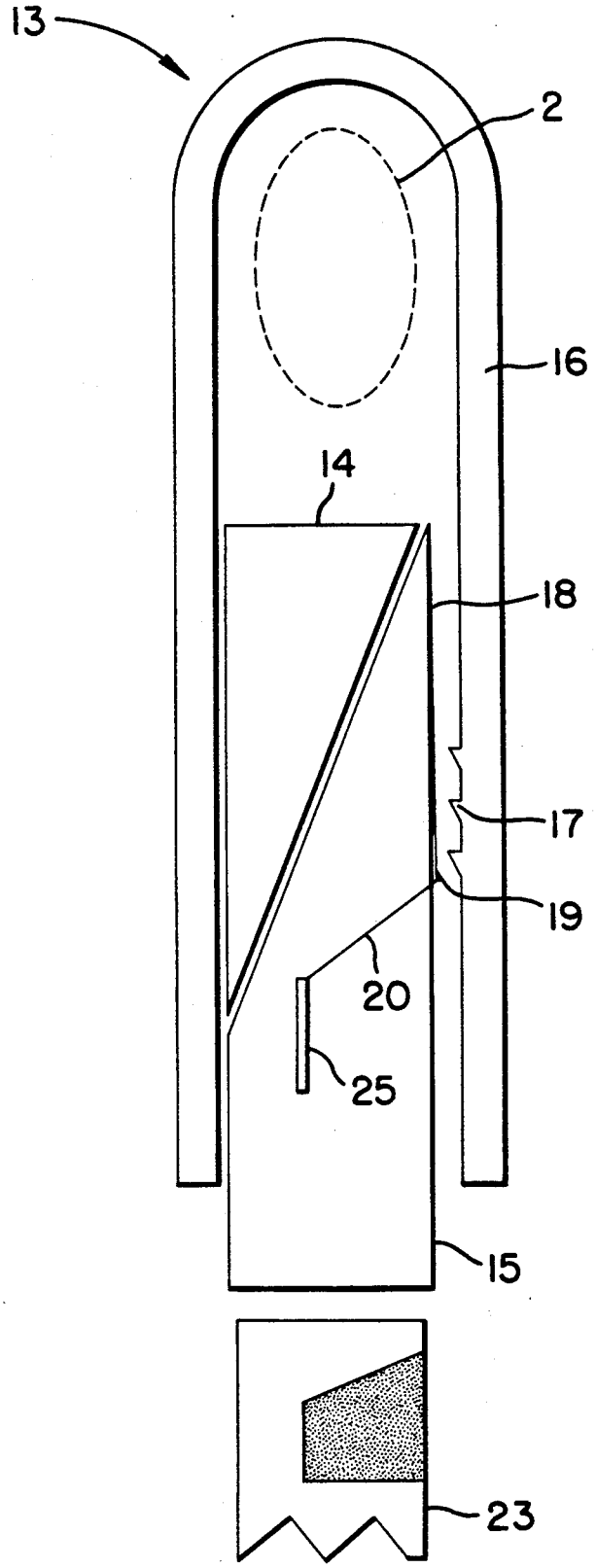
FIG. 2 shows a second embodiment of a theft detection tag in accordance with the principles of the present invention.

FIG. 2 illustrates a second embodiment of a theft detection tag in accordance with the principles of the present invention. This embodiment is similar to the embodiment of FIG. 1C with the exception that a different mechanism is provided for releasing the latching end 19 of the spring 18. In particular, a translatably mounted keyplate 25 has replaced the metal plate 21 and is moved inward by a cooperating key 23 inserted into the tag body.

Figure 3A:
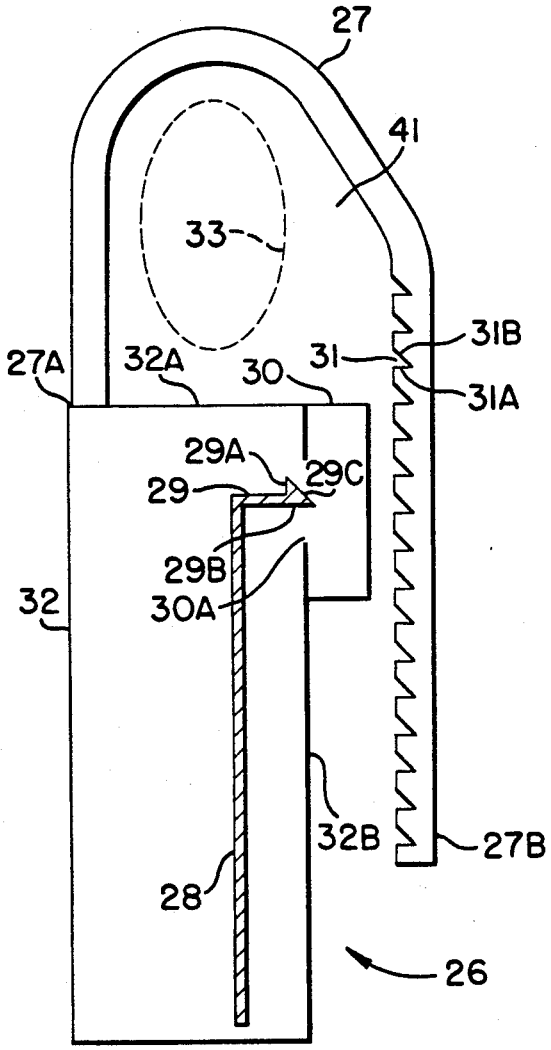
FIGS. 3A and 3B show a third embodiment of a theft detection tag in accordance with the principles of the present invention in a detached and attached state accordingly.

FIG. 3A illustrates a third embodiment of a theft detection tag in accordance with the principles of the present invention. In this embodiment, the first section or portion of the tag 26 is in the form of a flexible tie wrap or strap 27 having a first end 27A which is fixed to the body 32 of the tag and a second end 27B which is free. The second portion or section of the tag 26 comprises a tag body 32 which has a through channel or chamber means 30 on one wall 32B for receiving the flexible end 27A of the tie wrap.

Insertion of the tie wrap 27 through the channel 30 results in the wrap forming a loop with the upper end 32A of the tag body 32. This loop, as in the previous embodiments, defines an aperture 41 whose size can be varied to attach the tag to and release the tag from an article part 33 again indicated by dot dashed lines.

A spring 29 is positioned by a spring support 28 to project through an aperture 30A in the side wall 32B bordering the channel 30. The spring 29 engages teeth or grooves 31 in the flexible end 27A of the tie wrap 27 to latchingly couple the tie wrap to the tag body so as to provide secure attachment of the tag to the article.

Figure 3B:
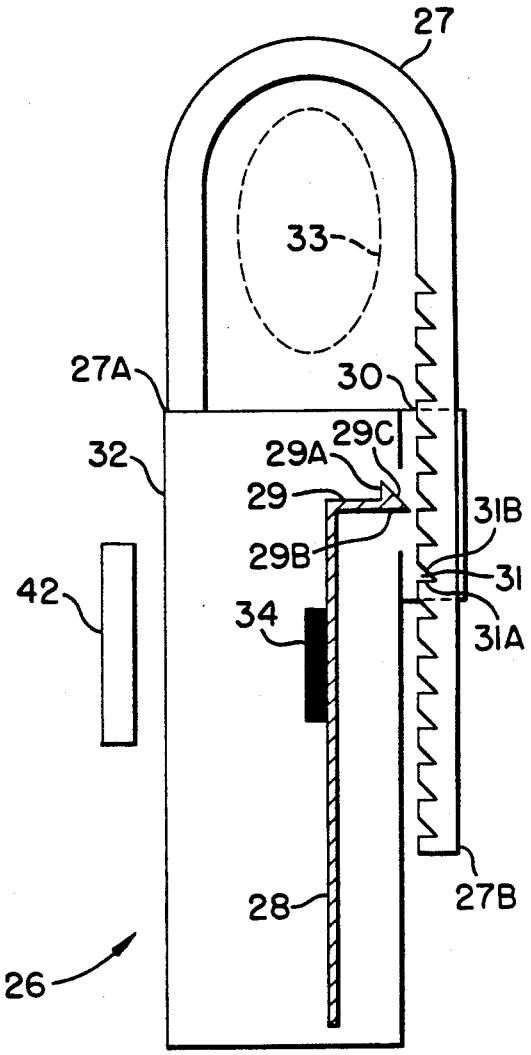

FIG. 3B shows this in greater detail. Thus, each groove 31 has a flat bottom 31A and an angled top 31B. The latching end 29A of the spring 29, in turn has a flat bottom 29B and an angled top 29C. When the free end 27B of the tie wrap 27 is pulled through the channel 30, the angled top 31B of the grooves 31 apply a sideways force against the angled top 29C of the latching end 29A. Therefore, the end 29A is moved inwards (towards the spring support 28), thus allowing the free end 27B of the tie wrap 27 to move in a downward direction. In this manner, the tie wrap 27 is tightened about the article part 33.

Also the tie wrap 27 cannot now be pulled up out of channel 30, due to the interaction between the latching end 29A and the grooves 31 of the tie wrap 27. Thus, when an upward force is applied to the tie wrap 27, the flat bottom 29B of the end presses against the flat bottom 31A of the groove 31, thereby preventing movement in the upward direction.

To permit upward movement of the tie wrap to release the tag from the article, the spring support 28 must be moved inward sufficiently to allow the latching end 29A to clear the flat bottom 31A of the grooves 31. This is achieved in the FIG. 3B embodiment by attaching a metal plate 34 to the spring support 28. When a magnet 42 is placed closely adjacent to the tag body 32, the attractive force between the metal plate 34 and the magnet 42 causes movement of the spring support 28 toward the magnet. This, in turn, moves the latching end 29A of the spring 29 out of the path of the grooves 31. The latching end 29A and the grooves 31 of the tie wrap 27 are, thus, disengaged and the tie wrap can be moved up and out of the tie channel 30.

As can be appreciated, the tag of FIGS. 3A and 3B allows quick attachment and quick release of the tag from the article being protected, like the tags of FIGS. 1 and 2. The tag of FIGS. 3A and 3B is further advantageous because the tag can be used with closed articles such as rings, since the flexible end 27A can be completely detached from the tag body 32, then wrapped around such article and then latched to the tag body as above-described. The tag of FIGS. 3A and 3B is also easily manually attachable and thus does not require a tool for this function.

Figure 4:
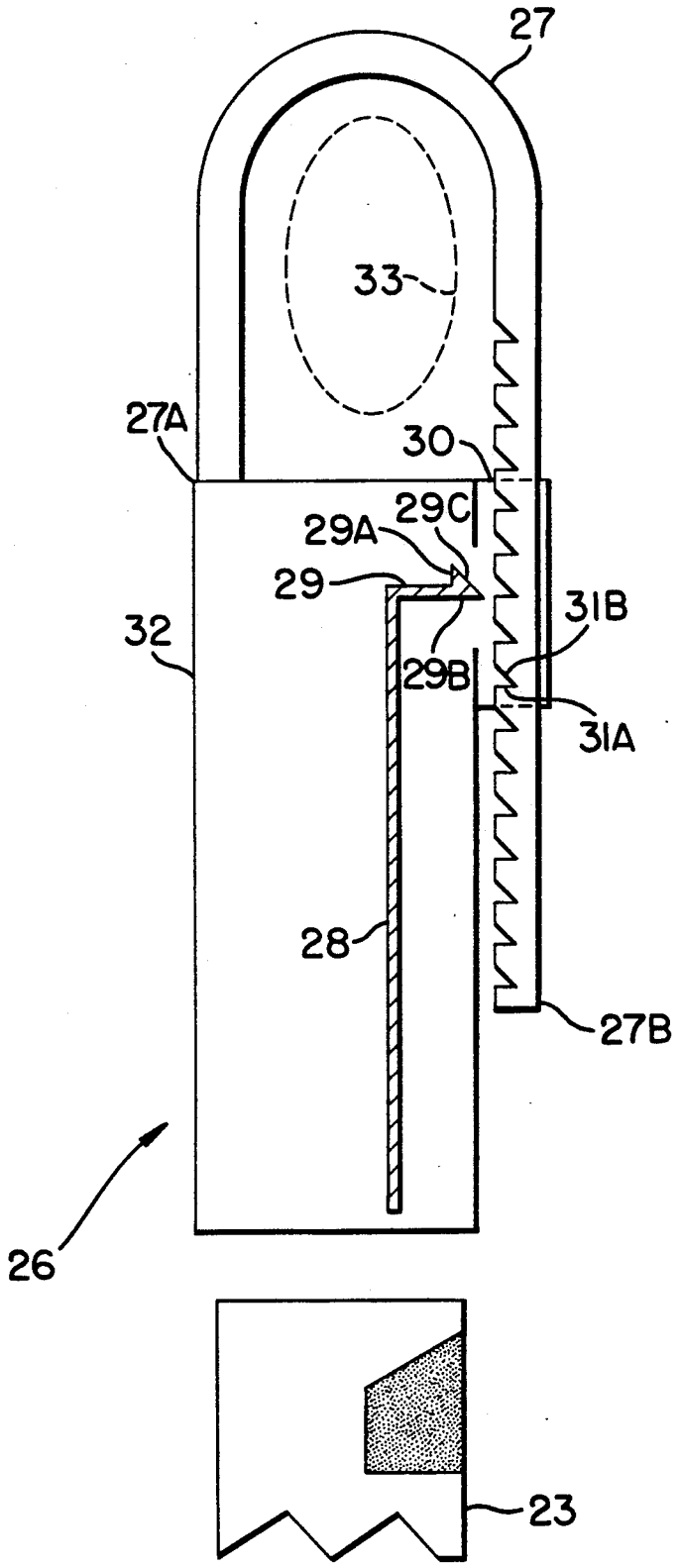
FIG. 4 shows a fourth embodiment of a theft detection tag in accordance with the principles of the present invention.

FIG. 4 illustrates a fourth embodiment of a theft detection tag in accordance with the principles of the present invention. This embodiment is similar to the third embodiment of FIGS. 3A, 3B with the exception that releasing the mechanism for the latching end 29A is through a key 23. The latter is inserted into the tag 26 to move the support 28 and spring 29 inward, thereby releasing the tie wrap end 27B and allowing it to be removed from channel 30.

It should be noted that each of the tags of FIGS. 1–4 is further provided with conventional magnetic, RF or microwave means for permitting the tag to be sensed by a sensing system. This is illustrated in FIG. IA, by the means 101 and sensing system 102. Accordingly, when the tag 16 is attached to an article, unauthorized removal of the article can be detected by the system 102 sensing the element In all cases it is understood that the above-described arrangements are merely illustrative of the many possible specific embodiments which represent applications of the present invention. Numerous and varied other arrangements can be readily devised in accordance with the principles of the present invention without departing from the spirit and scope of the invention. Thus, for example, in FIG. 1B, the shape of the latching end 19A and the shape of the teeth or ledges 17 can be changed provided motion is permitted in one direction but not in the other. Further, the shape of the key and the manner in which the latching end 19A is disengaged from the teeth 17 can be changed. Still further, an arrangement consisting of multiple spring arms and multiple latches may be used for locking engaging of the first and second tag sections. In such a case, a key is required that can disengage all the latches simultaneously thereby allowing removal of the tag.

What is claimed is:

1. A tag adapted to be used in an article surveillance system with an article to be protected, the tag comprising:

a fist tag section, said first tag section including a body having an upper end;

a second tag section cooperating with said first tag section to form a loop which enables the tag to be attached to and released from said article, said second tag section including wedge means movably disposed within said body and whose upper ends defines, with he upper end of said body, said loop; and mean for quickly coupling and releasing the first and second tag sections to change said loop and permit quick attachment and release of said tag and article, said coupling means releasably coupling said wedge means to said body.

2. A tage in accordance with claim 1 wherein:

said coupling mean includes means responsive to a magnet for releasing the first and second tage sections.

3. A tage in accordance with claim 1 wherein:

said coupling means includes means which is one of key and manually activate or activating said coupling.

4. A tage in accordance with claim 1 wherein:

said coupling means includes means responsive to a key for releasing the first and second tage sections.

5. A tag in accordance with claim 1 wherein:

said coupling means includes means responsive to a magnet for activating the release of said coupling of said wedge means to said body.

6. A tag in accordance with claim 1 wherein:

said coupling means includes means responsive to a key for activating the release of said coupling of said wedge means to said body.

7. A tag in accordance with claim 1 wherein:

said coupling means couples to the inner wall of said body.

8. A tag in accordance with claim 7 wherein:

said wedge means includes upper and lower mating wedge elements;

said coupling means includes: a spring attached to the lower wedge element and biased to engage said inner wall; and means for removing said bias to release said engagement.

9. A tag in accordance with claim 8 wherein:

said means for removing said bias includes magnetically responsive means attached to said spring.

10. A tag in accordance with claim 8 wherein:

said means for removing said bias includes key responsive means attached to said spring.

11. A tage in accordance with claim 8 wherein:

said inner wall includes teeth;

and said spring includes a latching member adapted to engage said teeth so as to permit movement of said lower wedge toward said upper end of said body and inhibit movement of said lower wedge away from said upper end of said body.

12. A tag in accordance with claim 11 wherein:

said means for removing said bias causes said latching member to move out o the path of said teeth.

13. A tage in accordance with claim 1 further comprising:

one of magnetic, rf and microwave means for permitting said tag to be sensed.

14. A system for detecting a tage attached to an article comprising:

the gag of claim 13;

and means for sensing sad one of magnetic, rf and microwave means.

15. A tage adapted to be used in an article surveillance system with an article to be protected, the tag comprising:

a first tage section, said first tag section including a flexible member having fist and second ends, said second end having teeth;

a second tage section cooperating with said first tag section to form a loop which enables the tage to be attached to and released from said article, said second tag section including a body having an upper end and a channel member along a first side wall;

said first end of said flexible member being connected to said upper end such that said second end of said flexible member can be passed through said channel to define said loop;

and means for quickly coupling and releasing the first and second tage sections to change said loop and permit quick attachment and release of said tage and article, said coupling means releasably coupling said second end of said flexible member to said body by releasably engaging said teeth of said second end of said flexible member when said second end is in said channel.

16. A tag in accordance with claim 15 wherein:

said coupling means includes means responsive to a magnet for activating the release of said coupling of said second end of said flexible member to said body.

17. A tag in accordance with claim 15 wherein:

said coupling means includes means responsive to a key for activating the release of said coupling of said second end of said flexible member to said body.

18. A tag in accordance with claim 14 wherein:

said side wall includes an opening into said channel;

said coupling means includes a spring movably supported on said body and projecting through said opening into said channel to engage said teeth of said second end of said flexible member.

19. A tag in accordance with claim 18 wherein:

said coupling means includes means for moving said spring so as disengage said spring and said second end of said flexible member.

20. A tag in accordance with claim 19 wherein:

said means for moving said spring includes magnetically responsive means attached to said spring.

21. A tage in accordance with claim 20 wherein:

said means for moving said spring includes key responsive means attached to said spring.

22. A tag in accordance with claim 19 wherein:

said spring includes a latching member adapted to engage said teeth of said second end of said flexible member so as to permit movement of said second end through said channel to inhibit movement of said second end from said channel.

23. A tag in accordance with claim 22 wherein:

said means for moving aid spring causes said latching member to move out o the path of aid teeth.

24. A tag in accordance with claim 15 further comprising:

one of magnetic, rf and microwave means for permitting said tag to be sensed.

25. A system for detecting a tage attached to an article comprising:

the tag of claim 24;

and means for sensing said one of magnetic, rf and microwave means.

* * * * *

UNITED STATES PATENT AND TRADEMARK OFFICE

CERTIFICATE OF CORRECTION

PATENT NO. : 5,079,540

DATED : January 7, 1992

INVENTOR(S) : Doug Narlow and Arjen Koch

It is certified that error appears in the above-identified patent and that said Letters Patent is hereby corrected as shown below:

Col. 1, line 51. After "by" insert -- a --

Col. 6, line 8. Change "fist" to -- first --

Col. 6, line 15. Change "he" to -- the --

Col. 6, lines 22, 24, 26. Change "tage" to -- tag --

Col. 6, line 28. Change "activate" to -- activatable -- and change "or" to -- for --

Col. 6, lines 30, 32, 57. Change "tage" to -- tag --

Col. 6, line 66. Change "o" to -- of --

Col. 6, line 67. Change "tage" to -- tag --

Col. 7, line 3. Change "tage" to -- tag --

Col. 7, line 5. Change "gag" to -- tag --

Col. 7, line 6. Change "sad" to -- said --

Col. 7, lines 8, 11. Change "tage" to -- tag --

Col. 7, line 12. Change "fist" to -- first --

Col. 7, lines 14, 15, 26, 27. Change "tage" to -- tag --

UNITED STATES PATENT AND TRADEMARK OFFICE

CERTIFICATE OF CORRECTION

PATENT NO. : 5,079,540

DATED : January 7, 1992

INVENTOR(S) : Doug Narlow et al

It is certified that error appears in the above-identified patent and that said Letters Patent is hereby corrected as shown below:

Col. 8, line 13. After "as" insert -- to --

Col. 8, line 18. Change "tage" to -- tag --

Col. 8, line 28. Change "aid" to -- said --

Col. 8, line 29. Change "o" to -- of -- and change "aid" to -- said --

Col. 8, line 34. Change "tage" to -- tag --

Signed and Sealed this

Sixth Day of April, 1993

*Attest:*

STEPHEN G. KUNIN

*Attesting Officer*

*Acting Commissioner of Patents and Trademarks*